US006441346B1

(12) United States Patent
Zychek

(10) Patent No.: US 6,441,346 B1
(45) Date of Patent: Aug. 27, 2002

(54) BURN-OUT FURNACE

(75) Inventor: George Zychek, Stratford, CT (US)

(73) Assignee: Jeneric/Pentron, Inc., Wallingford, CT (US)

( * ) Notice: Subject to any disclaimer, the term of this patent is extended or adjusted under 35 U.S.C. 154(b) by 0 days.

(21) Appl. No.: 09/946,077

(22) Filed: Sep. 4, 2001

(51) Int. Cl.[7] ..... F27B 3/20; F27D 11/00

(52) U.S. Cl. ..... 219/411; 219/410; 219/402; 219/534

(58) Field of Search ..... 219/411, 410, 219/402, 409, 534, 546, 548, 553; 392/408, 416; 373/127, 119

(56) References Cited

U.S. PATENT DOCUMENTS

| | | | | | |
|---|---|---|---|---|---|
| 724,069 | A | * | 3/1903 | Winter | 219/406 |
| 1,234,499 | A | * | 7/1917 | Smalley | 219/546 |
| 2,963,529 | A | * | 12/1960 | Schmidt | 373/119 |
| 3,688,084 | A | * | 8/1972 | Charneski | 219/546 |
| 3,749,882 | A | | 7/1973 | Pilkington | |
| 4,007,325 | A | | 2/1977 | Bowles | |
| 4,695,705 | A | | 9/1987 | Kulig | |
| 4,767,916 | A | | 8/1988 | Curtila | |
| 6,063,715 | A | | 5/2000 | Holbeck | |

* cited by examiner

*Primary Examiner*—Joseph Pelham
(74) *Attorney, Agent, or Firm*—Ann M. Knab

(57) ABSTRACT

A burn-out furnace having heating system configured in a series or plurality of radiating sleeves aligned on top of one another against at least one wall of the burn-out furnace. At least one heating element is disposed in the radiating sleeves. The heating element is preferably a single piece of wire which is coiled or wound along its entire length and curved after it exits each radiating sleeve to continue into the next tube, and "zig-zag" through the plurality of tubes. The heating element is stretched to a point whereby during operation of the furnace, when the heating element is heated, there is little or no creeping of the wire occurring. Moreover, the heating element contains very tight turns between the sleeves as the direction of the element reverses and it continues the zig-zag configuration through the plurality of radiating sleeves.

17 Claims, 3 Drawing Sheets

BURN-OUT FURNACE

FIELD OF THE INVENTION

The present invention relates generally to a burn-out furnace and more specifically to a configuration for heating elements contained in the burn-out furnace.

BACKGROUND OF THE INVENTION

In the manufacture of dental restorations, the dental practitioner prepares the tooth to be restored by grinding the subject tooth or teeth down to form one or more tooth preparations to which the prosthetic device is to be attached. An impression of the tooth preparation is taken in an elastic material and the impression is used to produce a model and dies. At this point, various techniques may be used to fabricate the dental restoration. One such technique involves the lost wax process whereby a pattern of the lost tooth structure or the desired dental prosthesis is constructed in wax on the die. The wax is enveloped by a material called an investment, which is typically a mixture of water, silica, and a binder. After the investment slurry has set, the wax is burned out of the mold in a burn-out furnace. The burn-out furnace serves to burn-out the wax pattern which is used to make the mold shape. It also cures the mold material, a ceramic shell, insuring the mold is perfectly dry prior to casting. It is very important that all the wax has been removed and the mold is dry prior to casting or there will likely be an explosion when liquid metal is poured into the mold.

Current burn-out furnaces may have heating elements disposed vertically in the muffle of the furnace. Due to the vertical positioning of the wires, over time and usage, the wires begin to gravitate and sag to the bottom of the furnace, and eventually collapse into a mass at the bottom of the furnace. This results in uneven heating, creating a heat sink in the lower section of the furnace and a cool section in the upper section of the furnace.

In addition to the vertical arrangement of the heating elements, many of the current burn-out furnaces have heating elements arranged in a horizontally S-type mounting pattern whereby the wires are wound very tightly in order to fit a large volume of wire into a small area. The close proximity of the coil spacing to one another results in inefficient heating, since the wires tend to become very hot internally and are too close to one another to dissipate heat effectively. The heat from the elements should be dissipated into the muffle, but instead, it becomes trapped between the elements. The heating elements may reach their thermal limit prior to radiating enough heat to heat the muffle or to maintain the muffle at the desired temperature, thereby reducing the utility of the furnace.

It is desirable to provide a burn-out furnace having heating elements disposed in such a way as to reduce sagging of the elements. It is preferable that the burn-out furnace be provided with heating elements designed to provide effective and efficient heating to the muffle.

SUMMARY OF THE INVENTION

These and other objects and advantages are accomplished by the burn-out furnace of the present invention having a series or plurality of radiating tubes or sleeves aligned on top of one another against at least one wall of the burn-out furnace. At least one heating element is disposed in the radiating sleeves. The heating element is preferably a single piece of wire which is coiled or wound along its entire length and curved or bent after it exits each radiating sleeve, preferably in the form of a tube, to continue into the next tube, and "zig-zag" through the plurality of tubes. The heating element is stretched to a point whereby during operation of the furnace, when the heating element is heated, there is little or no creeping of the wire occurring. Moreover, the heating element contains very tight turns between the sleeves as the direction of the element reverses and it continues the zig-zag configuration through the remainder of the plurality of radiating sleeves. The burn-out furnace is useful in the manufacture of dental restorations, heat treatment of metal, and general laboratory uses.

BRIEF DESCRIPTION OF THE DRAWINGS

Features of the present invention are disclosed in the accompanying drawings, wherein similar reference characters denote similar elements throughout the several views, and wherein.

DESCRIPTION OF THE INVENTION

Figure 1:
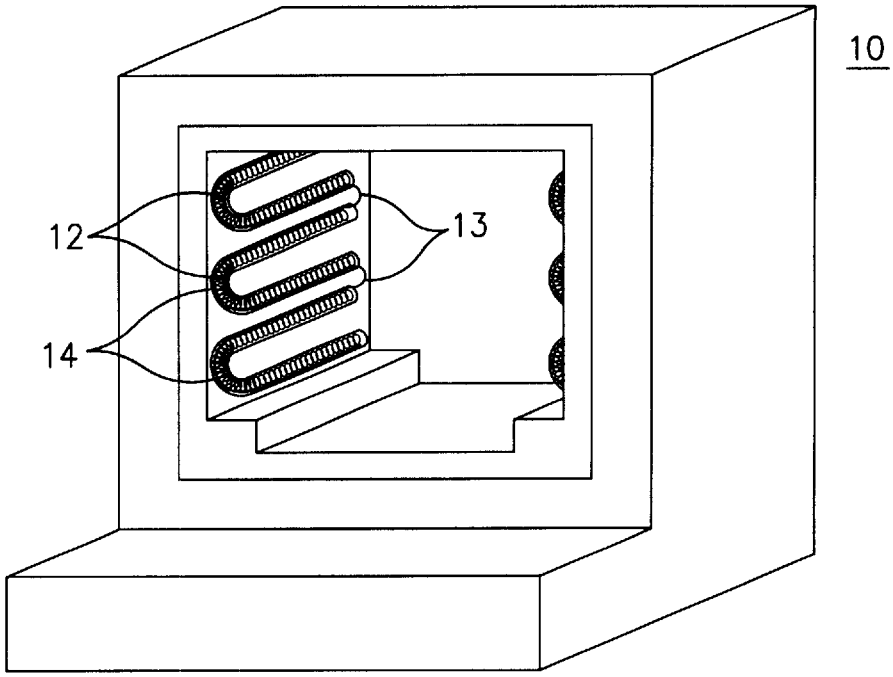
FIG. 1 (PRIOR ART)
FIG. 1 is a perspective view of a prior art burn-out furnace.
Figure 2:
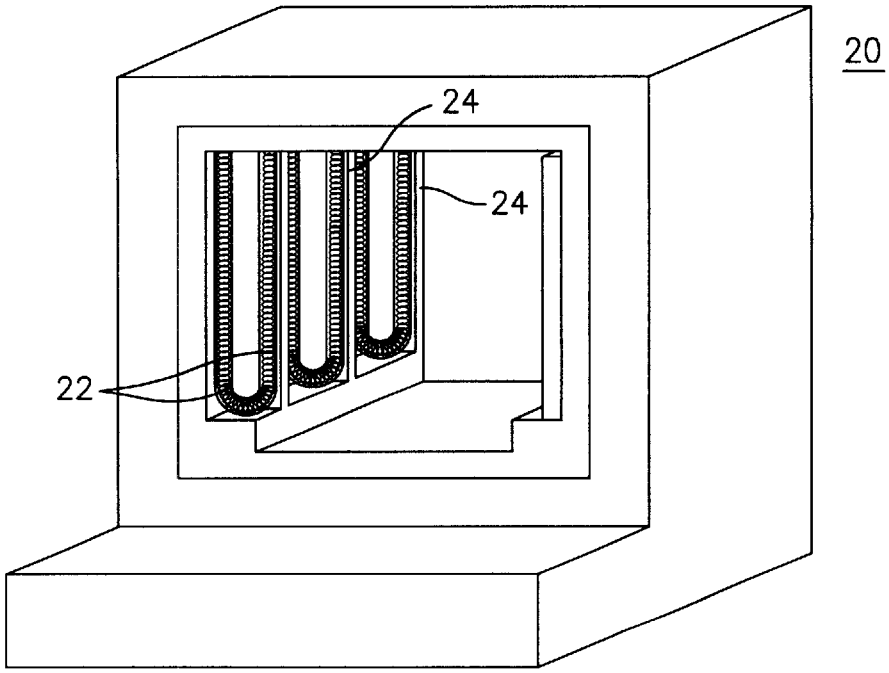
FIG. 2 (PRIOR ART)
FIG. 2 is a perspective view of a prior art burn-out furnace.

As will be appreciated, the present invention is directed to a new and improved burn-out furnace providing efficient heating for burn-out operations. Turning to FIGS. 1 and 2, therein illustrated are examples of prior art burn-out furnaces. FIG. 1 shows a furnace 10 having heating element 12 disposed in a horizontal, serpentine configuration. Heating element 12 is contained in tubes 14, designed in the shape of a hairpin or a laterally positioned U. Heating element 12, located in each tube 14, extends outside the end of one tube and continues into the end of a second U-shaped tube as shown at 13. The disadvantage of this design is that in order to meet the desired wattage of heat from the heating element, the wire must be wound very tightly and close together to provide the required heat output for the furnace. The wire must be wound tightly due to the small amount of tubing provided.

FIG. 2 depicts a prior art burn-out furnace 20 having a heating element 22 disposed vertically in a serpentine configuration. Heating element 22 is located in an insulation material 24 having a continuous serpentine configuration. A large percentage of the heating element is positioned vertically in the furnace, which design will eventually lead to sagging of the wire toward the bottom of the furnace resulting in uneven heating. Moreover, insulation material 24 is a high-density material and absorbs much of the heat from heating element 22, thereby trapping heat that would otherwise be directed to the muffle of the furnace. This reduces the efficiency of the furnace, requiring longer heat-up periods to compensate for thermal energy lost to the insulation material.

Figure 3:
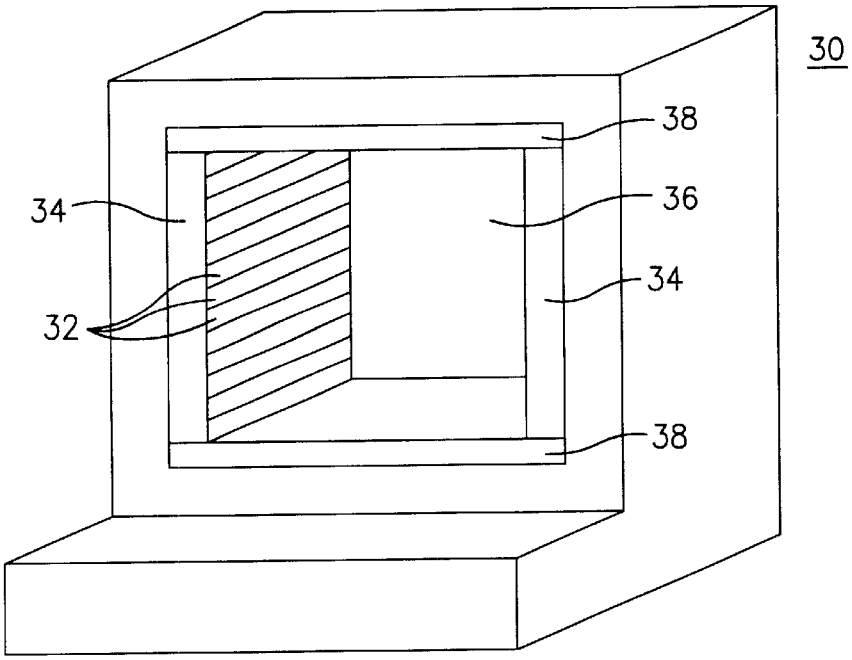
FIG. 3 is a perspective view of a burn-out furnace of the invention.
Figure 4:
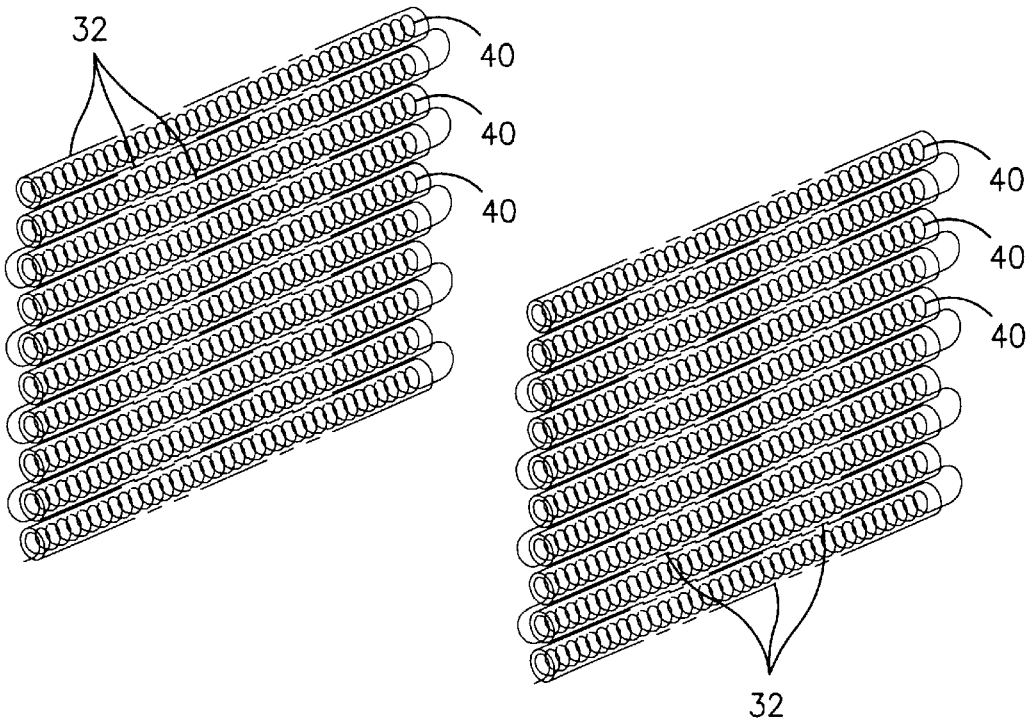
FIG. 4 is a perspective view of the heating elements of the burn-out furnace shown in FIG. 3.

FIG. 3 depicts a furnace 30 of the invention having radiating sleeves 32 disposed along the wall of furnace 30. The radiating sleeves 32 are aligned on top of one another against the wall of furnace 30. The sleeves are preferably in the form of tubes as more clearly shown in FIG. 4. The tubes in FIG. 4 are shown aligned on top of one another as they would be positioned in the furnace. FIG. 4 displays two sets of radiating tubes 32 to be positioned along the right and left walls of furnace 30 shown in FIG. 3. FIG. 4 also shows a resistance heating element 40 positioned in each set of tubes 32. Depending upon the material used to fabricate the sleeves, heating element 40 may be visible through sleeves 32. Preferably, heating element 40 is at least slightly visible through sleeves 32. FIG. 4 displays the shape and position of element 40 as seen internally in radiating sleeves 32. Heating element 40 is preferably a single piece of wire that is coiled or wound along its entire length and bent or curved after it exits each tube to continue into the next tube to extend through the plurality of tubes 32. As shown, element 40 begins at the uppermost tube and extends slightly out of the end of the uppermost tube, is curved downwardly and continues in the reverse or backward direction into the end of the second tube in line, continuing the "zig-zag" formation throughout the plurality of tubes to the lowermost tube. Optionally, the heating element may consist of more than one wire, although it is preferable to have a single element to provide the most efficient heating to the unit. If more than one element is used, the two or more elements must be connected to one another. The resistance heating element 40 can comprise any conventional metal or alloy useful as heating elements for high temperature, electrically heated furnaces. Among such heating elements are included molybdenum, tungsten, iron, nickel, platinum, aluminum, chromium, cobalt, and alloys of these metals. Preferable commercially available alloys useful as heating elements are available from Kanthal Corporation, Bethel, CT and include Kanthal™ and Nikrothal™ heating alloys. Nikrothal is a nickel-chromium alloy and Kanthal is an iron-chromium-aluminum alloy.

Radiating sleeves 32 are held snugly against the wall 50 of furnace 30 (shown in FIG. 5) and abut against upper and lower surfaces of one another. Radiating sleeves 32 are preferably held in place mechanically to allow for expansion or slight movement of the sleeves. Chemical bonding of sleeves 32 is not recommended because it may limit slight movement of sleeves 32. Radiating sleeves 32 can be fabricated from any conventional rigid material which is stable at high temperatures and pressures and which provides, adequate electrical insulation for resistance heating element 40. Materials which can be suitably utilized include, but are not limited to, silica and alumina. Preferably fused silica, also known as quartz, is used in clear, transparent quality or in diffuse, translucent quality. Commercially available Vitreosil® translucent tubing available from Quartz Products Company, Lousiville, Ky. is an example of preferred tubing for use as radiating sleeves 32 herein. Translucent alumina is another preferred material for fabrication of sleeves 32. Commercially available Lucalox™ available from General Electric is one such example of alumina.

The shape of the radiating sleeves 22 of this application is not critical. The radiating sleeves 32 suitably can be generally spherical or generally tubular. The radiating sleeves 32 also can suitably have interior and exterior surfaces with a circular or an elliptical configuration in cross-section, as well as a polygonal configuration in cross-section, such as a square or a pentagonal configuration. Sleeves 32 provide direct support for helically wound heating elements over substantially the entire length of each heating element 40, and loosely enclose heating elements 40 to allow elements 40 to fully expand radially within sleeves 32. Heating elements 40 are stretched to a point whereby when the heating elements are heated, there is little or no creeping of the wire occurring. Moreover, heating elements 40 contain very tight turns between sleeves 32 as the direction of the elements 40 reverse as they continue the zig-zag configuration through the plurality of radiating sleeves 32.

Furnace 30 may include brackets 34 fabricated of an insulating material to frame the entrance to the muffle 36 of furnace 30 and maintain tubes 32 in position. Bars 38 are positoned at the top and bottom of the furnace entrance to complete the frame to the entrance and are fabricated of an insulating material. The insulating material may comprise any refractory material such as alumina, silica, mullite and the like.

In the zig-zag configuration, the wire is given adequate space to radiate out in all directions. Instead of heating itself up, like many of the heating elements in current furnaces, the heating element herein radiates heat into the muffle of the furnace. The amount of winding in the heating element and the length of the heating element provide optimum furnace temperature. The amount and thickness of the wire is important for determining heat capacity for the furnace. The large number of radiating sleeves and close positioning of the sleeves to one another provides effective, adequate space for placement of heating elements 40. Due to the large number of radiating sleeves 32 and the close positioning thereof, the heating element may be wound somewhat loosely to provide space for heat to dissipate therefrom and into the furnace muffle. The number and size of radiating sleeves will depend upon the size of the furnace. A furnace will generally have about 8 to about 15 sleeves positioned along one wall of the furnace. In a small furnace, the radiating sleeves will be smaller in diameter and the number of sleeves may vary from about 10 to about 12 sleeves. A larger furnace may user larger sleeves which may number in range from about 8 to about 12. The number of coils per inch is dependent on the wire used. Typically, the finer the wire, the more coiling is required. It is preferable to use as thick a wire as possible, to provide the most heat to the muffle of the furnace. The wire diameter is in the range of about 0.5 mm to about 2.5 mm, and preferably in the range of about 1 mm to about 2 mm in diameter. The length of the wire is determined from the resistance of the wire. For example, Kanthal™ AF No. 16 wire has a resistance of 0.234 ohms per foot. The length of the wire will be dependent on the necessary resistance that the furnace will utilize, and the actual resistance the wire exhibits. It is preferable that the coil diameter be about 10% to about 15% smaller than the nominal internal diameter of the sleeve to ensure that all coils will fit easily into all tubes, thereby giving sufficient clearance between the coil and tube wall to prevent any possibility of the tubes bursting at high temperatures. The outer diameter of the sleeve is in range of about 3 to about 20 mm in diameter, and preferably about 7 to about 15 mm in diameter.

Figure 5:
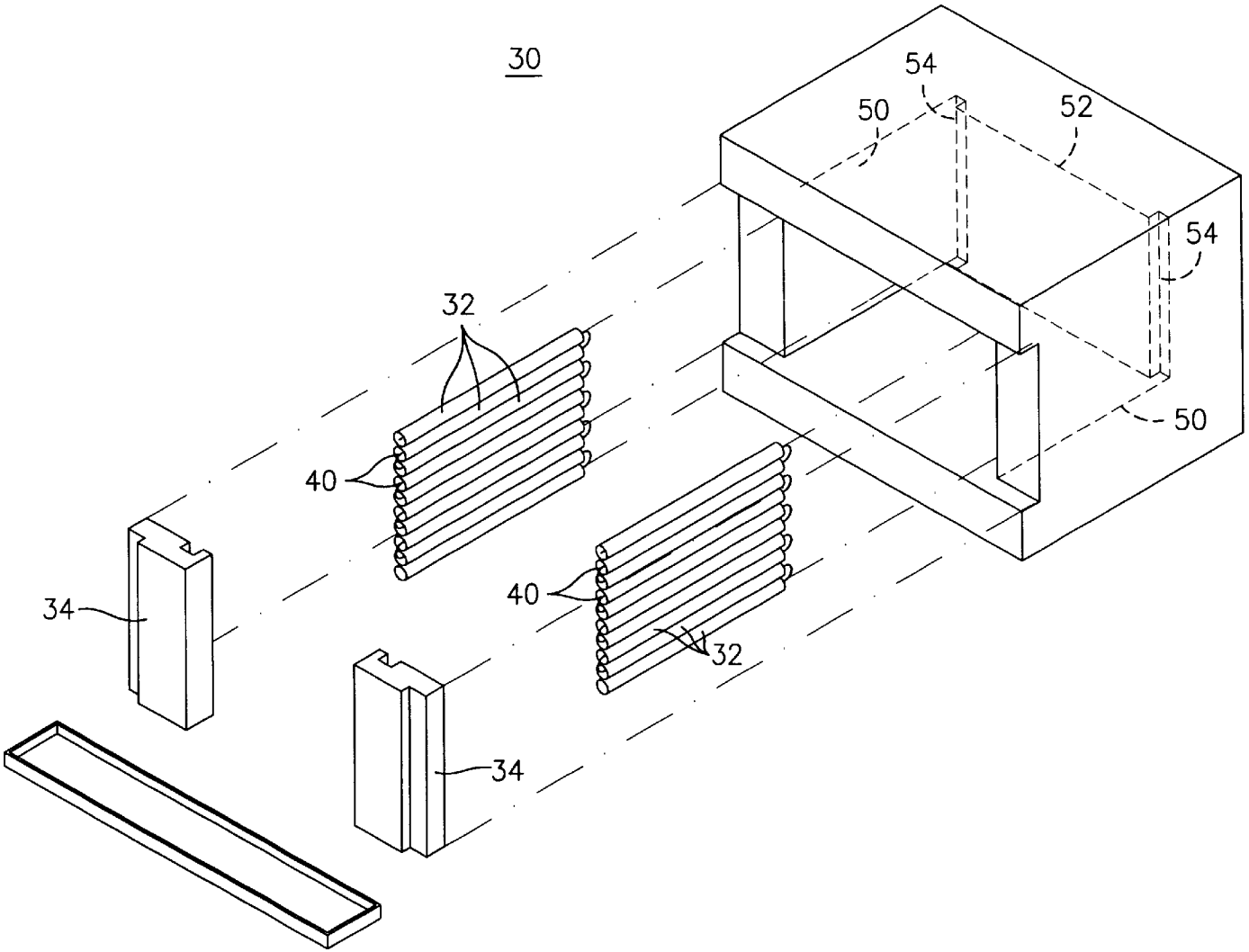
FIG. 5 is an exploded perspective view of the assembly of components of the burn-out furnace of FIG. 3.

FIG. 5 depicts an exploded view of several of the components of furnace 30 clarifying how the components fit together. Back wall 52 of furnace 30 is provided with slots or sections 54 for placement of radiating sleeves or tubes 32. Wall 50 is fabricated of an insulating material such as the refractory materials mentioned above.

The configuration of the heating elements in the burn-out furnace provides an efficient and highly effective system for heating. The configuration is designed to provide extended use of the heating elements, preventing sagging and creeping thereof, to provide uniform heating to the muffle of the furnace.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A burn-out furnace comprising:

at least one heating element disposed in a plurality of radiating sleeves;

wherein the radiating sleeves are aligned horizontally along their length and juxtaposed along at least one wall of the furnace; and wherein the at least one heating element is disposed horizontally in the plurality of radiating sleeves and extends in a zig-zag configuration throughout the plurality of radiating sleeves.

2. The burn-out furnace of claim 1 wherein the zig-zag configuration comprises the at least one heating element disposed horizontally through a first radiating sleeve, whereby the heating element extends slightly outside the first radiating sleeve, and continues in a downward and backward direction into a second radiating sleeve.

3. The burn-out furnace of claim 2 wherein the zig-zag configuration further comprises the at least one heating element disposed horizontally in the second radiating sleeve, whereby the heating element extends slightly outside the second radiating sleeve, and continues in a downward and forward direction into a third radiating sleeve.

4. The burn-out furnace of claim 3 wherein the at least one heating element continues the zig-zag configuration, and extends slightly outside the ends of the remaining plurality of radiating sleeves to continue and complete the zig-zag configuration.

5. The burn-out furnace of claim 4 wherein the zig-zag configuration comprises the at least one heating element being extended in a very tight turn as it exits one radiating sleeve and enters another radiating sleeve.

6. The burn-out furnace of claim 1, wherein the radiating sleeves are aligned along the entire side of at least one wall of the furnace.

7. The burn-out furnace of claim 6, wherein the radiating sleeves are aligned along the entire side of at least two walls of the furnace.

8. The burn-out furnace of claim 1 wherein the radiating sleeves are fabricated of a heat-transmitting material.

9. The burn-out furnace of claim 8 wherein the heat-transmitting material comprises alumina or silica, or mixtures thereof.

10. The burn-out furnace of claim 9 wherein silica is quartz.

11. The burn-out furnace of claim 1 wherein the at least one heating element comprises a high heat-resistant wire.

12. The burn-out furnace of claim 11 wherein the high heat-resistant wire comprises molybdenum, tungsten, iron, nickel, platinum, aluminum, chromium, cobalt, or a mixture thereof.

13. The burn-out furnace of claim 12 wherein the heat-resistant wire further comprises one or more rare earth elements.

14. The burn-out furnace of claim 12 wherein the heat-resistant wire further comprises a silicon, hafnium, yttrium or a mixture thereof.

15. The burn-out furnace of claim 1 for use in the manufactur e of dental restoration.

16. The burn-out furnace of claim 1 for use in heat treating metal.

17. The burn-out furnace of claim 1 for general laboratory use.

* * * * *